US005274204A

United States Patent [19]

Mauro

[11] Patent Number: 5,274,204

[45] Date of Patent: Dec. 28, 1993

[54] PRESSURE ACTUATED ELECTRICAL CONTACT SWITCH

[76] Inventor: George Mauro, 18 Simpson Rd., Windham, N.H. 03087

[21] Appl. No.: 769,634

[22] Filed: Sep. 30, 1991

[51] Int. Cl.[5] ..... H01H 1/12; H01H 3/16; H01H 35/00

[52] U.S. Cl. ..... 200/52 R; 200/239; 200/283

[58] Field of Search ..... 200/1 A, 1 TK, 6 B, 200/6 C, 52 R, 61.58 R, 61.82, 239, 275, 283, 284

[56] References Cited

U.S. PATENT DOCUMENTS

| | | | |
|---|---|---|---|
| 3,674,969 | 7/1972 | Engle | 200/283 X |
| 4,196,328 | 4/1980 | Ishikawa | 200/283 X |
| 4,436,971 | 3/1984 | Kim | 200/295 |

*Primary Examiner*—J. R. Scott
*Attorney, Agent, or Firm*—John M. Brandt

[57] ABSTRACT

A pressure actuated electrical contact switch composed of two planar electrodes having substantially thinner contact members extending therefrom and disposed at an obtuse angle. The electrodes are bound together by electrically insulating epoxy and the contact members are arranged in proximate spaced apart relationship such that pressure on one causes mechanical and electrical contact with the other.

4 Claims, 1 Drawing Sheet

PRESSURE ACTUATED ELECTRICAL CONTACT SWITCH

BACKGROUND OF THE INVENTION

1. Field of the Invention

The invention resides in the field of electrical contact switches wherein the contacts are closed by the application of an external force upon at least one of the contacts.

2. Description of the Prior Art

There is an abundance of commercially available electrical contact switches for sensing the proximity of mechanical elements in instrumentation. These are used most often to limit the travel of a moveable component or to set in motion additional assemblies of the device. Difficulty is encountered as the size of the mechanisms is reduced as the parts thereof become more fragile and require smaller switch units due to size limitations.

At the same time the requirement for reliability may increase due to the inaccessibility of the equipment or the difficulty of replacing a non-functioning switch because of size and product design constraints. The present invention was created to address these problems in the construction of a miniature motorized stage more particularly described in U.S. Pat. No. 5,007,620, issued Dec. 31, 1991, to the same inventor.

The applicant is unaware of any mechanism similar to the invention described herein in the prior art.

SUMMARY OF THE INVENTION

The invention may be summarized as a pressure actuated electrical contact switch especially suited for applications involving fragile components of small size. The switch is composed of a pair of planar electrodes separated from and bound to one another by an electrically insulating epoxy. Each electrode terminates in a substantially thinner contact member forming an obtuse angle with the base.

Cut outs are made in the contact at the boundary between the contact and base portions of both electrodes to facilitate bending of the contacts and bases with respect to one another. It has been found advantageous to provide a larger cut out in the actuating electrode than the receiving electrode to reduce resistance of the actuating electrode for the purpose of diminishing contact point wear.

Additionally a pair of concentric mounting holes one larger than the other are provided transverse the plane of the assembly to allow the switch to be secured to the device with which it is to be used without additional fixtures such as cases, brackets or the like.

These and other features and advantages of the invention will become more clear from the description of the preferred embodiment and drawings which follow.

DESCRIPTION OF THE PREFERRED EMBODIMENT

Figure 1:
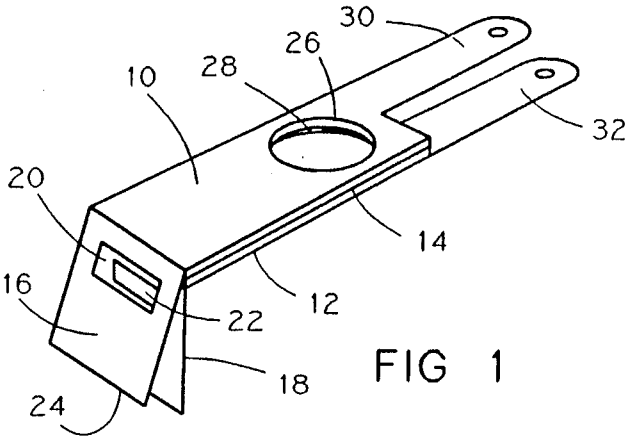
FIG. 1 is a perspective view of the preferred embodiment of the invention.

Referring first to FIG. 1 the preferred embodiment of the invention is illustrated in perspective. A pair of planar electrode bases 10 and 12 form the main body of the switch and are bound together by a thin layer of electrically insulating epoxy 14. Each electrode base has a substantially thinner contact member 16 and 18 respectively extending therefrom at substantially equal obtuse angles. As will be seen, the contacts are thus arranged to be in close proximate spaced apart relationship in their unactuated state.

Cut outs 20 and 22 are formed in the contact members at the boundary with the thicker electrode bases and provide a means by which the contact members may be bent to obtain the preferred configuration of the invention.

The cut out 20 on the actuating contact 16 is preferably of a greater area than cut out 22 to result in a somewhat weaker bond. This will result in less wear at the actual electrical connection point between the two contact members. This may be provided by, for example, a folded tab 24 from or an indentation in contact 16. To insure continued electrical reliability over the life of the switch, gold plating of the contacts is a desirable procedure.

A pair of mounting holes 26 and 28 are formed in the electrode bases such that the entire assembly may be screw mounted. Preferably the receiving electrode mounting hole 28 is larger than the companion actuating electrode mounting hole 26 to prevent electrical shorting.

Tabs 30 and 32 attached to electrodes 10 and 12 respectively provide junctions for electrical leads to complete the assembly. Depending upon the manner in which the switch is used these tabs are not always necessary to form appropriate electrical connections.

Figure 2:
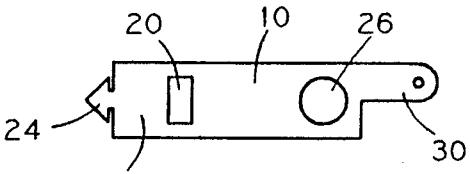
FIG. 2 is a plan view of one component of the embodiment of FIG. 1.
Figure 3:
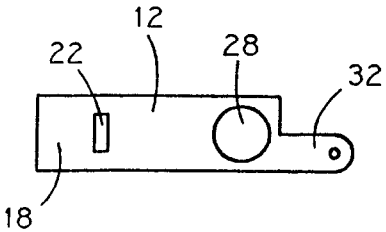
FIG. 3 is a plan view of a second component of the embodiment of FIG. 1.

Referring next to FIG. 2, a plan view of actuating electrode 10 is shown in the form in which it is manufactured prior to bending. FIG. 3 is a similar view of receiving electrode 12. As shown, cut out 20 is of greater area than cut out 22.

Figure 4:
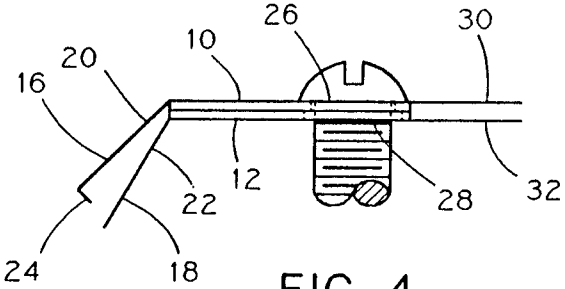
FIG. 4 is a side view of the embodiment of FIG. 1.

FIG. 4 is a side view of the entire assembly and further illustrates the configuration and positioning of the various elements of the switch.

In order to appreciate the scale for which the present invention is appropriate, it is beneficial to examine some of the dimensions of a unit which has been manufactured for use in the motorized stage described in the above referenced patent.

In these, the thickness of each base 10 and 12 is 0.005 inch and the thickness of the contact members 16 and 18 is 0.002 inch and the thickness of the junction tabs 30 and 32 is 0.002 inch. The overall length of the device from the outside edge of the contact members 16 and 18 to the outside edge of the junction tabs 30 and 32 is approximately 0.4 inch and the width of each base 10 and 12 is approximately 0.1 inch. Mounting hole 26 is 0.06 inch in diameter and mounting hole 28 is 0.07 inch in diameter.

The cutout 20 in the actuating contact 16 is 0.03 inches by 0.05 inches. The cutout 22 in the receiving contact 18 is 0.03 inches by 0.04 inches. As will be appreciated by those skilled in the art, components of this type lend themselves readily to manufacture in quantity by photo etching.

Figure 5:
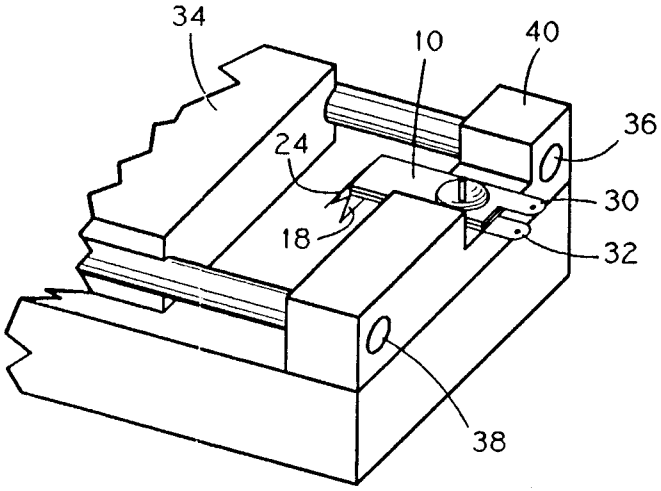
FIG. 5 is a perspective view illustrating the use of the invention in a mechanical stage.

FIG. 5 illustrates the use of the switch of the invention in the previously mentioned motorized stage. Slider 34 is mounted between rails 36 and 38 and is driven forward or backward by a motor unit not shown. The rails are attached to a mounting block 40 by electrically insulating epoxy. Each rail is connected to one side of the switch unit by wires 42 and 44 thus enabling the rails to be used as electrical conductors in applications for which the stage is particularly suitable.

Variations in the above described apparatus may be made without departing from the scope of the invention which accordingly is hereby defined by the following claims.

I claim:

1. A pressure actuated electrical contact switch assembly for miniature applications comprising in combination:

a. a first planar electrode comprising:

1. a first base;
2. a substantially thinner first contact member integral with and positioned at an obtuse angle with respect to the plane of said first base;

b. a second planar electrode comprising:

1. a second base;
2. a substantially thinner second contact member integral with and positioned at a second obtuse angle with respect to the plane of said second base;

said first and second angles being substantially equal to one another; said first and second bases mutually attached by an electrically insulating epoxy adhesive such that said first and second contact members are in proximate spaced apart relationship;

said first and second contact members each having a cut out portion adjoining the boundary of the respective contact member and base;

said first and second bases each having a mounting hole transverse the surface of said bases, the mounting hole of said first base being larger than and aligned with the mounting hole of said second base;

said contact members arranged to complete an electrical circuit between said electrodes upon mutual engagement resulting from an external force applied to one of said contact members.

2. The switch assembly of claim 1 wherein said cut out portions are unequal in area.

3. The switch assembly of claim 1 further including a junction tab attached to each base for providing electrical connections to said electrodes of said switch.

4. The switch assembly of claim 1 wherein said contact members are gold plated.

* * * * *